US006408483B1

(12) United States Patent
Salice

(10) Patent No.: US 6,408,483 B1
(45) Date of Patent: Jun. 25, 2002

(54) BRAKING RETARDATION APPARATUS

(75) Inventor: Luciano Salice, Carimate (IT)

(73) Assignee: Arturo Salice S.p.A., Novedrate/Como (IT)

( * ) Notice: Subject to any disclaimer, the term of this patent is extended or adjusted under 35 U.S.C. 154(b) by 0 days.

(21) Appl. No.: 09/451,134

(22) Filed: Nov. 30, 1999

(30) Foreign Application Priority Data

| | | |
|---|---|---|
| May 4, 1999 | (DE) | 299 07 931 U |
| Jun. 17, 1999 | (DE) | 299 10 626 U |
| Nov. 30, 1999 | (DE) | 298 21 364 U |

(51) Int. Cl.[7] ..... E05F 5/06
(52) U.S. Cl. ..... 16/85; 16/82
(58) Field of Search ..... 16/85, 86 R, 86 A, 16/82, 51, 62, 64, 69; 292/DIG. 15, DIG. 19

(56) References Cited

U.S. PATENT DOCUMENTS

| | | | | | |
|---|---|---|---|---|---|
| 889,168 | A | * | 5/1908 | Zopechen et al. | 16/64 |
| 1,198,829 | A | * | 9/1916 | Edwards | 16/51 |
| 1,205,433 | A | * | 11/1916 | Christman | 16/57 |
| 1,519,584 | A | * | 12/1924 | Kreipke | 16/69 |
| 1,526,395 | A | * | 2/1925 | Swanson | 16/79 |
| 1,576,286 | A | * | 3/1926 | Lang | 16/57 |
| 1,700,086 | A | * | 1/1929 | Sherwood | 16/85 |
| 1,704,217 | A | * | 3/1929 | Rosenthal et al. | 16/82 |
| 1,816,024 | A | * | 7/1931 | Petersen | 16/85 |
| 2,449,686 | A | * | 9/1948 | Brinda | 16/85 |
| 3,909,877 | A | * | 10/1975 | Christy et al. | 16/85 |
| 4,302,864 | A | * | 12/1981 | Morita | 16/82 |
| 4,872,239 | A | * | 10/1989 | Ferguson et al. | 16/85 |

FOREIGN PATENT DOCUMENTS

| | | | |
|---|---|---|---|
| DE | 3729597 | 3/1989 | |
| DE | 4135216 | 4/1993 | |
| DE | 29621043 | 1/1997 | |
| DE | 19717937 | 5/1998 | |
| GB | 685251 | * 12/1952 | 16/85 |
| IT | 534065 | * 10/1955 | 16/85 |

* cited by examiner

*Primary Examiner*—Chuck Y. Mah
(74) *Attorney, Agent, or Firm*—Dilworth & Barrese LLP

(57) ABSTRACT

The invention is directed to a simply designed and easy-to-operate brake retardation apparatus in which a push rod is moveable in guides of a housing and possesses a section formed as a gear rack which meshes with a pinion of a shock absorber also retained in the housing.

13 Claims, 4 Drawing Sheets

BRAKING RETARDATION APPARATUS

BACKGROUND OF THE INVENTION

The invention relates to a braking retardation apparatus for doors or the like consisting of a push rod which can be pressed into a housing against a braking force.

Brake retardation or absorption apparatuses of this type are used, for example, for the braking of doors and in particular of furniture doors just before their closed positions in order to brake the impact effect and to ensure the smoothest possible closing. Brake retardation apparatuses are used in particular when the doors and furniture doors are provided with closing devices which press them into their closed positions and hold them therein. Brake retardation apparatuses of the type given can, however, also be used for other parts, in particular furniture parts, for example drawers or flaps, to prevent these from reaching or impacting their end positions with force and disturbing noise.

From DE 197 17 937 A1 a brake and absorption element for moving furniture parts of the type first given is known where the housing consists of a cylinder-like sleeve and the push rod of a piston movable and spreadable in a radial direction therein, with the air contained in the cylinder cavity being compressed therein by pressing in the piston, with the piston being designed in such a way that the compressed air effects a radial spreading of the piston and thus its rubbing on the interior wall of the sleeve.

SUMMARY OF THE INVENTION

It is the object of the invention to provide a simply designed and easy-to-operate brake retardation apparatus of the type first given.

In accordance with the invention this object is solved by the push rod being movable in guides of the housing and possessing a section consisting of a gear rack which meshes with the pinion of a rotary shock absorber held in the housing.

Rotary shock absorbers of this type are known and commercially available. They normally consist of a shaft supported in a closed cylindrical housing which shaft carries a radially projecting plate or wing-like plates in the housing, which strokes over plates or projections in a fixed position relative to the housing in a non-contact manner, with a highly viscous fluid, for example silicone oil, being filled in the sealed housing. The pinion is set on a shaft journal led out of the housing. In accordance with a preferred embodiment it is provided that the push rod is acted upon by a spring in the push-out direction. Here, the spring can be designed to be so weak that it cannot overcome the retaining force of a closing device of a door.

Appropriately, the braking torque of the rotary shock absorber only acts in the push-in direction. Such rotary shock absorbers are also known. In these, the pinion is connected to the shaft carrying the wings by, for example, a freewheel acting in the push-out direction. In the closed state of the door, the rotary shock absorber exerts no action because the braking torque only occurs when there is a relative movement of the components.

The push rod can be guided in boreholes or passages of housing walls opposite each other. Appropriately, the spring consists of a compression spring enclosing a section of the push rod and clamped between the rear housing wall and the gear rack.

In accordance with another embodiment the object is solved by the push rod being the piston rod of a piston guided movably in a cylinder, by the cylinder being filled with a fluid, e.g. oil, and by the piston being provided with a throughway valve which opposes the extension of the piston with only a low resistance and the insertion with a high resistance, by a compression spring being clamped between the piston and the cylinder bottom and by a head being set on the piston rod.

The valve can, for example, consist of a flap valve or an annular valve body which expose a large borehole cross-section or a large cross-section of an opening of the piston when the piston extends and which, when the piston is pushed in, reach their closed positions in which only a small opening is revealed for the fluid which opening restricts the fluid for the generation of the braking effect.

Appropriately, the head consists of a cushion of elastomeric material so that the door impacts the piston rod with low noise and the cushion forms a buffer which thanks to its soft resilience does not damage the door.

In another aspect of the invention it is provided that the cylinder is fitted in a blind borehole, e.g. on the front side of a top panel of a cupboard and is supported on the head of a screw screwed into a thread of a sleeve located at the bottom of the blind borehole. By screwing in or unscrewing, the brake retardation apparatus can therefore be adjusted to the closing position of the door.

Appropriately, the borehole is fitted into a sleeve provided with a flange. This sleeve lines the outer edge region of the borehole and extends over the borehole edge with its flange. In the pressed-in state of the push rod, the head set on the piston rod then lies in this sleeve.

Another object of the invention comprises providing a braking apparatus for doors, windows or moving furniture parts, e.g. drawers, consisting of a push rod which can be pushed against a braking or absorbing force into a housing or cylinder, which braking apparatus is mounted in a particularly effective manner without creating an irritating appearance.

This object is solved in accordance with the invention by the housing or the cylinder being fixed to the front side of a frame, e.g. a rail, a top panel or a side panel of a cupboard, which is protruded over by the push rod provided with a fitted head.

In another aspect of the invention, the brake retardation apparatus in accordance with the invention can be fixed in a largely obscured manner not creating an irritating appearance to a position on a frame which is the closing frame for a door, a window, a drawer or the like.

Preferably the push rod and the housing or the cylinder possess one or more features of the type described above.

With pivotable furniture parts, for example, doors or flaps, the braking apparatus can be mounted at such a distance from the hinge side that it ensures a good braking effect and that the braking force of the braking apparatus is adapted in an optimum manner to the closing torque of the pivotable furniture part.

BRIEF DESCRIPTION OF THE DRAWINGS

Embodiments of the invention are described in more detail below by means of the drawing in which

FIG. 9 shows a side view of a braking apparatus consisting of a cylinder having a front flange and a nut which can be screwed on;

DESCRIPTION OF THE PREFERRED EMBODIMENTS

Figure 1:
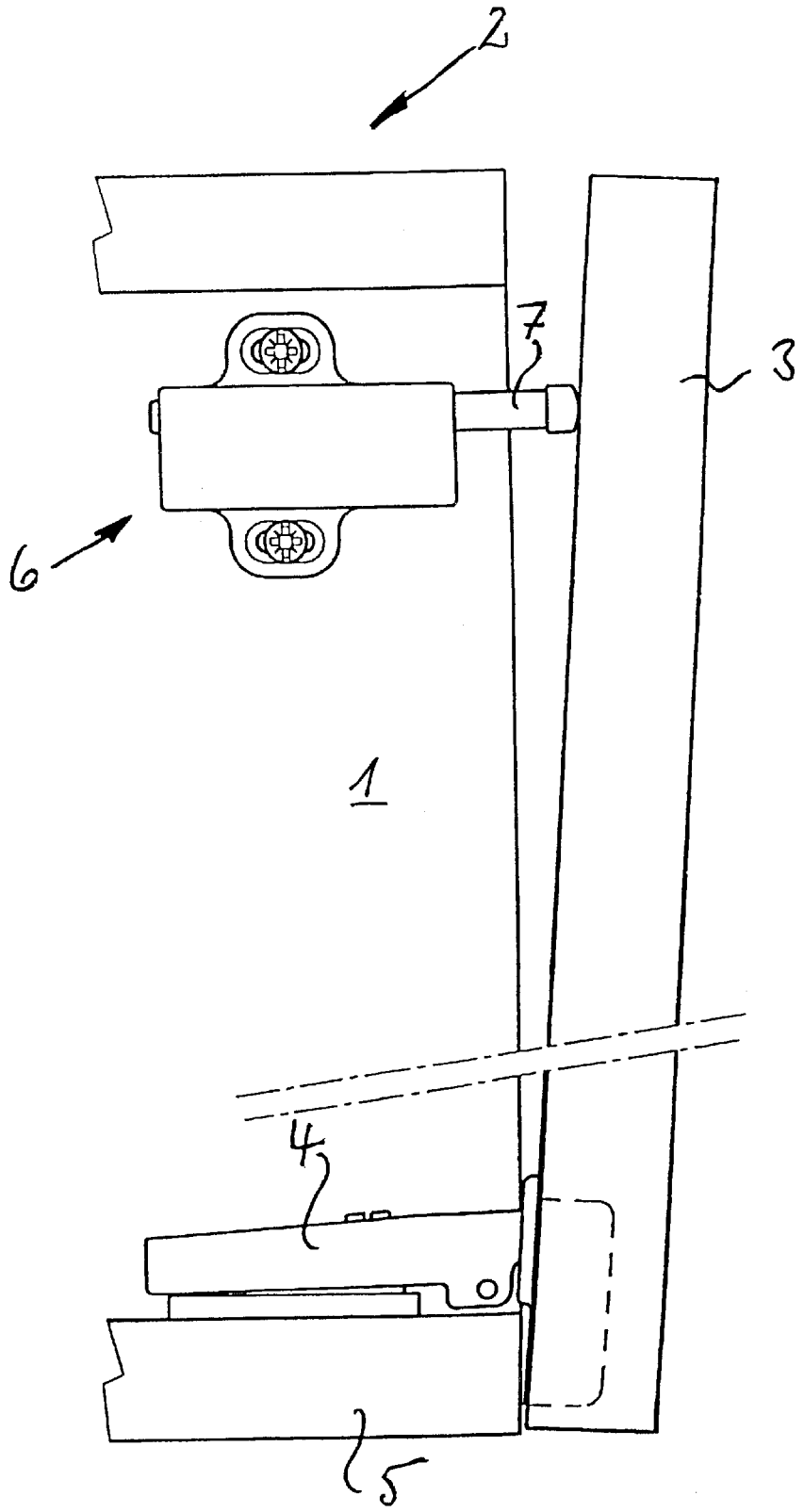
FIG. 1 shows a top view of the bottom and/or the top panel of a cupboard whose door is braked in the closing area by a brake retardation apparatus.

In FIG. 1 a view of the opening side of the bottom or top panel 1 of a cupboard 2 can be seen which can be closed by a door 3 which is hinged to a side panel 5 of the cupboard 2 by conventional hinges 4, for example double-link hinges, with closing devices generating a closing pressure. To prevent any unwanted impacting of the door 3 in its closing position, brake retardation apparatuses 6 are fixed to the bottom or the top plate 1, the push rods 7 of which brake retardation apparatuses extend over the opening plane of the cupboard 2 in the manner shown in the open position of the door so that it brakes a closing door in its closing region by the door pressing the push rod 7 inwards while consuming its rotary energy until the door reaches its closed position under the effect of absorption.

Figure 2:
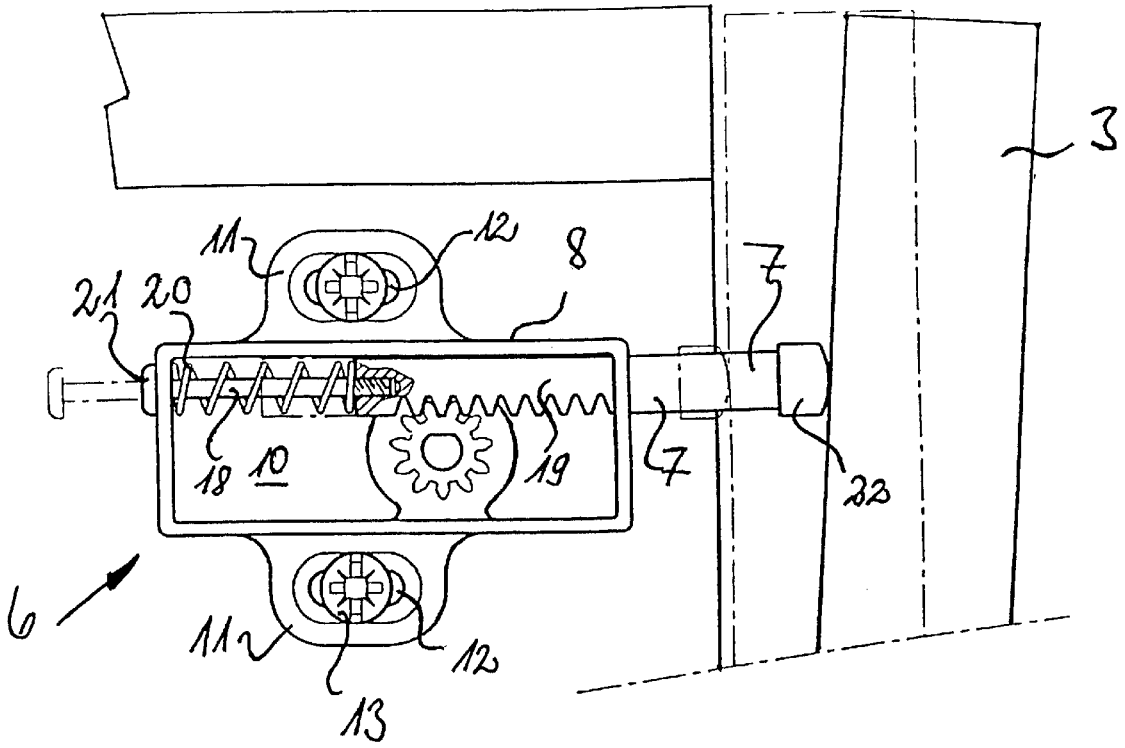
FIG. 2 shows the brake retardation apparatus of FIG. 1 with a removed top plate.
Figure 4:
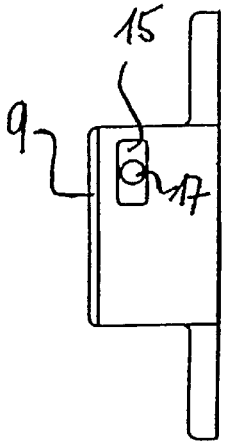
FIG. 4 shows a view of the housing in the direction of the arrow A in FIG. 3.
Figure 3:
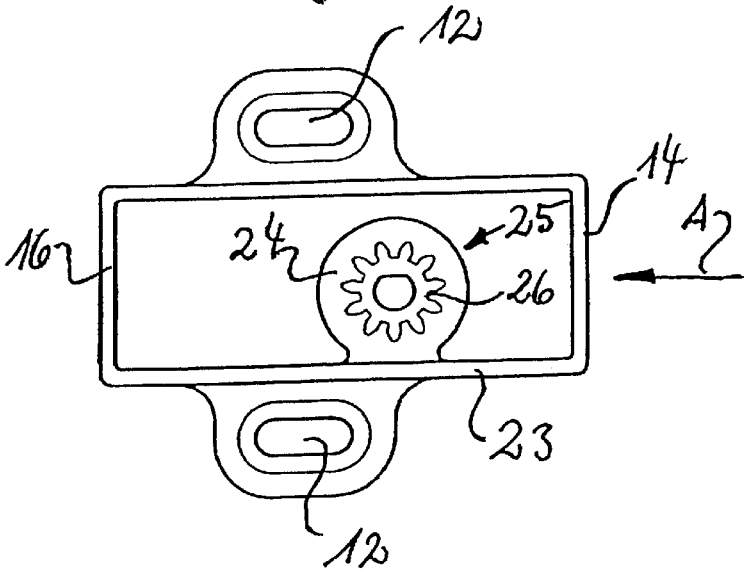
FIG. 3 shows a top view corresponding to FIG. 2 of the housing of the brake retardation apparatus with the push rod removed for better clarity.

In FIGS. 1 and 2, the position of the door and the push rod 7 is shown by unbroken lines which they assume relative to each other when the door 3 hits the push rod 7 in the closing region. The closed position of the door with the inserted push rod 7 is shown in dash-dot lines.

The absorption apparatus 6 consists of a rectangular tub-shaped housing 8 whose open top side can be closed by a top plate 9 which can be pressed in, for example, in a non-positive manner. The housing 8 possesses in the plane of the bottom plate 10 lateral wing-like protrusions 11 which are provided with oblong holes 12 which form mounting boreholes for mounting screws 13. Due to the oblong holes 12, the brake retardation apparatus 6 can be aligned in the required manner in the axial direction of the push rod.

The front wall 14 of the housing 8 is provided with a rectangular opening 15 for the push rod 7 also rectangular in the cross-section, while the rear wall 16 possesses a round borehole 17 for the passing through of a pin-shaped part 18 of the push rod 7. The push rod 7 rectangular in the cross-section is formed inside the housing 8 as a gear rack section 19. The gear rack section 19 is provided at its rear end with a tapped hole into which the pin 18 is screwed. The pin 18 penetrates a compression spring 20 clamped between the rear front side of the gear rack section 19 and the edge of the borehole 17. The pin 18 is provided at its end penetrating the borehole 17 with a head 21 which forms a stop on the rear housing wall 16 in the pushed-out position of the push rod 7.

A cap 22 made of rubber or another absorbing material is fitted to the front end of the push rod 7.

On a housing side panel 23, there is fitted the cylindrical housing 24 of a rotary shock absorber 25 on whose journal extending over the housing a pinion 26 is wedged. The gear rack section of the push rod 7 meshes with the pinion 26 in the manner visible from FIG. 2. The rotary shock absorber 25 is designed in such a way that the pinion only exerts a braking force on the push rod 7 in its push-in direction, while the push rod 7 can be pushed out again with practically no force by the compression spring 20, for example by the installation of a freewheel in the rotary shock absorber. The compression spring 20 can therefore be designed with a very weak force so that its force can be overcome in the closed state of the door 3 by the closing mechanism of the hinge joints.

Figure 5:
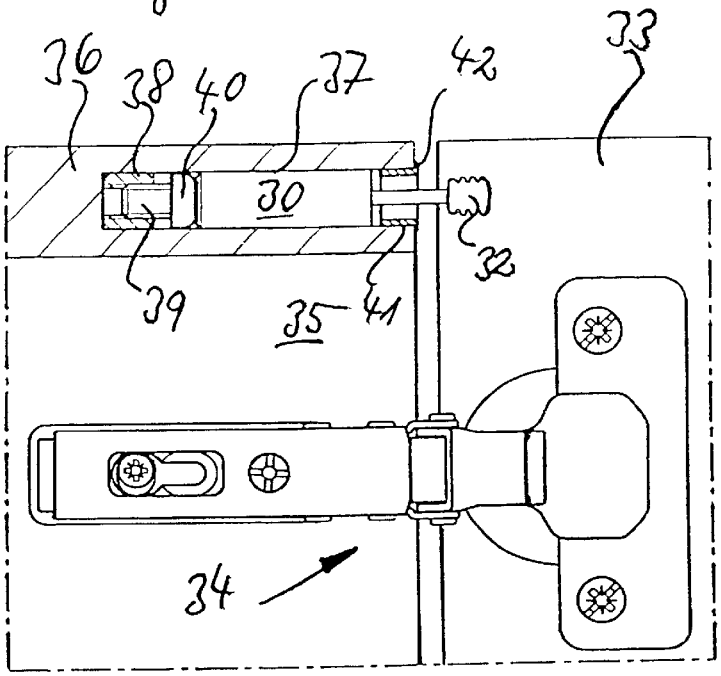
FIG. 5 shows a section through a top panel of a cupboard in the region of a blind borehole accepting a cylinder of a brake retardation apparatus in the extended state of the braking piston.
Figure 6:
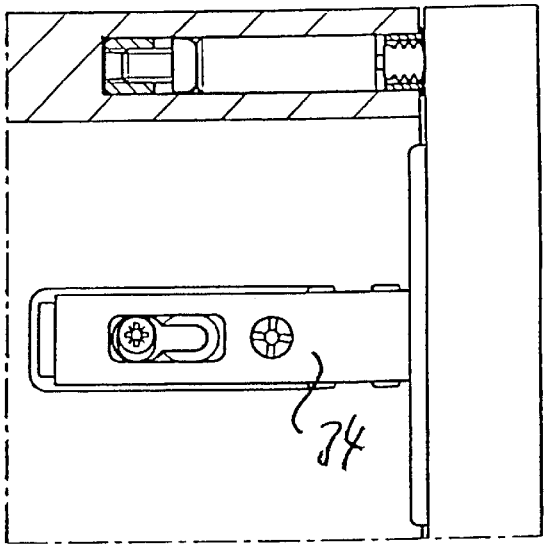
FIG. 6 shows a representation corresponding to that of FIG. 5 in the inserted position of the braking piston.
Figure 7:
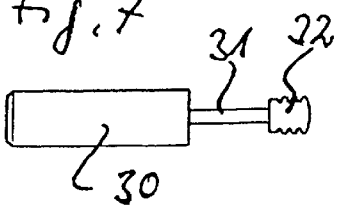
FIG. 7 shows a side view of the cylinder with the head made of elastomeric material set on the piston rod of the braking piston.

A second embodiment of the brake retardation apparatus in accordance with the invention is now described by means of FIGS. 5 to 7. The brake retardation apparatus consists of a cylinder 30 in which a piston (not shown) is movably guided. The piston is connected to a piston rod 31 which penetrates a borehole provided with a sealing of a lid (not shown) of the cylinder. The cylinder 30 is filled with a fluid, for example oil of a suitable viscosity, which when the piston moves in the cylinder 30 enters into the front cylinder chamber from the rear one and vice versa. The piston is provided with one or more boreholes or with an annular opening bridged by bars which can be closed by a valve flap or a valve body in such a way that the boreholes or openings are opened in the push-out direction of the piston, while when the piston is pushed in, the flaps or the valve seat move in their closed positions in which these only open a throttle cross-section of such a size that the piston rod can only be pushed into the cylinder with a given resistance.

The piston is subjected to the pressure of a compression spring clamped between the piston and the cylinder bottom. This compression spring pushes the piston into the extended position visible in FIGS. 5 and 7.

On the piston 31, a cap 32 made of an elastomeric material is fixed which ensures a gentle, damage-free pushing of the door 33 onto the piston rod 31.

The door 33 is hinged to a side panel 35 of, for example, the cupboard by conventional link hinges 34. The top panel 36 of the cupboard is provided with a blind borehole 37 in whose bottom a threaded sleeve 38 is located, for example made of brass. In the thread of the threaded sleeve 38, a screw 39 is screwed on whose head 40 the cylinder 30 of the brake retardation apparatus is supported. In the blind borehole 37, there is further fitted a sleeve 41 provided with a circumferential annular flange 42 which is supported on the borehole edge in the manner shown. In the pushed-in state of the piston rod 31, the cap or the head 32 fitted on the piston rod 31 is located in the region of the sleeve 41.

The force of the compression spring pushing out the piston is less than the force holding the door 33 closed so that the compression spring cannot press open the door by means of the piston and the piston rod 31.

Figure 8:
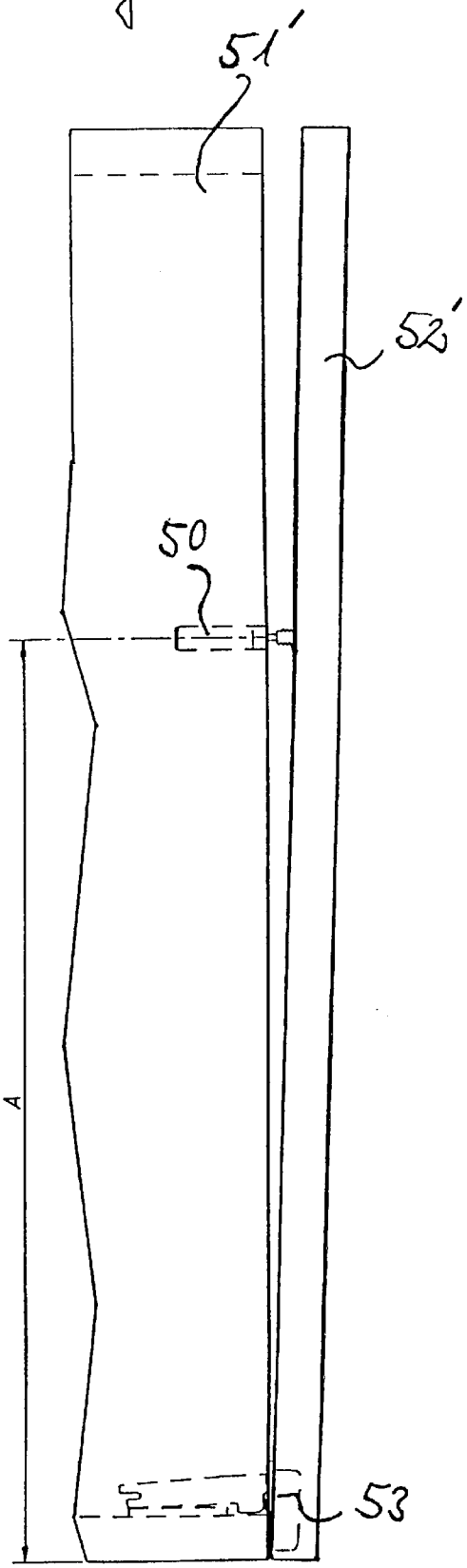
FIG. 8 shows a top view of the bottom and/or the top panel of a cupboard whose door or flap is braked at an optimised distance from the hinge side by a brake retardation apparatus.

From FIG. 8, the assembly of a braking apparatus 50 onto the front side of a top or bottom panel of a cupboard body 51 can be seen, this being at an optimised distance A from the hinge side of the door or flap 52. Depending on the distance A of the braking apparatus 50 from the hinge 53 of the door or flap, the braking apparatus acts in the closing region at a different angle of opening, with the door or flap acting on the braking apparatus with varying force in accordance with the lever length given by the distance A. The distance A is to be selected in dependence on the thickness or weight of the door or flap. Appropriately, the distance A corresponds at least roughly to the half of the width of the door as measured from the hinge side.

Figure 9:
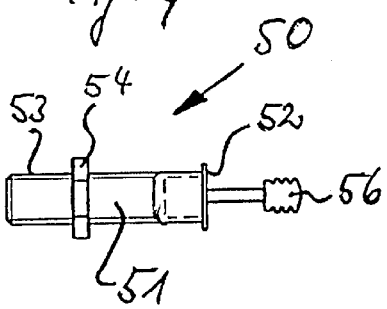

In the embodiment of FIG. 9, the braking apparatus 50 possesses a cylinder 51 provided with a front flange 52 for contact on a borehole edge. The cylinder 51 is provided with a thread 53 on which a nut 54 can be screwed.

The cylinder possesses at its front end a recess or clearance in which the head 56 made of elastically resilient material can dip in the manner shown by a broken line.

Figure 10:
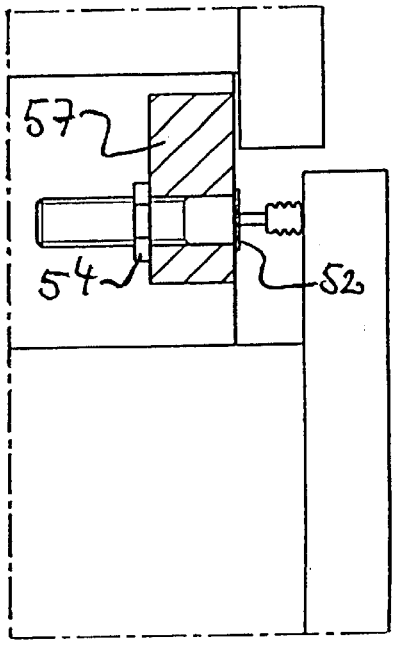
FIG. 10 shows the braking apparatus of FIG. 9 mounted on the upper edge of a drawer opening.

From FIG. 10, another assembly example of the braking apparatus 50 can be seen. A drawer opening is provided below its upper edge with a rail 57 fixed to the drawer body, which rail possesses a passage borehole in the manner shown. In the passage borehole, a braking apparatus of the type visible in FIG. 9 is fixed in such a way that the flange 52 is supported on the front edge region of the passage borehole. The braking apparatus 51 is secured in the passage borehole by the nut 54 screwed onto the cylinder 51.

What is claimed is:

1. A braking retardation apparatus for doors (3) and comprising a push rod (7) arranged to be pressed into a housing (8) against braking force, wherein the push rod (7, 18, 19) is structured and arranged to be movable in guides (15, 17) of the housing (8) and possesses a section constituted by a gear rack (19), comprising a rotary shock absorber (25) mounted in the housing (8) and comprising a pinion (26) structured and arranged to mesh with the gear rack (19), and the push rod (7) being structured and arranged to be guided in boreholes (17) or openings (15) of housing walls (14, 16) opposite each other.

2. A braking retardation apparatus in accordance with claim 1, additionally comprising a compression spring (20) structured and arranged to subject the push rod (7) to pressure in an extending direction of the push rod (7).

3. A braking retardation apparatus in accordance with claim 2, wherein the rotary shock absorber (25) is structured and arranged such that braking torque thereof only acts upon retraction of the push rod (7).

4. A braking retardation apparatus in accordance with claim 2, wherein the compression spring (20) is structured and arranged to encompass a section (18) of the push rod (7) and be clamped between a rear housing wall (16) situated away from the door (3) and the gear rack section (19).

5. A braking retardation apparatus in accordance with claim 1, wherein the rotary shock absorber (25) is structured and arranged such that braking torque thereof only acts upon retraction of the push rod (7).

6. A braking retardation apparatus in accordance with claim 5, additionally comprising a compression spring (20) structured and arranged to encompass a section (18) of the push rod (7) and be clamped between a rear housing wall (16) situated away from the door (3) and the gear rack section (19).

7. A braking retardation apparatus in accordance with claim 1, additionally comprising a compression spring (20) structured and arranged to encompass a section (18) of the push rod (7) and be clamped between a rear wall (16) of the housing (8) situated away from the door (3) and the gear rack section (19).

8. A braking apparatus in accordance with claim 7, wherein said section (18) is constituted by a pin-shaped part (18) structured and arranged to be screwed into a tap hole provided in said gear rack section (19) and having a head (21) at an end penetrating a borehole (17) provided in the rear housing wall (16) to form a stop on the rear housing wall (16) in an extending position of the push rod (7).

9. A braking retardation apparatus for doors (3), and comprising a push rod (7) which is structured and arranged to be pressed into a housing (8) against a braking force, wherein the push rod (7) is constituted by a piston rod (31) of a piston structured and arranged to be movably guided in a cylinder (30), the cylinder (30) is structured and arranged to be filled with fluid and provided with a passage valve structured and arranged to counter extension of the piston with low resistance and retraction or insertion of the piston into the cylinder (30) with high resistance, a compression spring (20) is structured and arranged to be clamped between the piston and a bottom of the cylinder (30), a head (32) is fitted upon the piston rod (31), and comprising one of the following (i)–(iii):

(i) the head (32) being constituted by a cushion of elastomeric material;

(ii) the cylinder (30) being structured and arranged to be fitted into a blind bore hole (37) of a structure (35, 36) upon which the door (33) is movably or pivotally mounted, and additionally comprising a threaded sleeve (38) located at a bottom of the blind borehole (37), and a screw (39) comprising a head (40) and structured and arranged to be screwed into the threaded sleeve (38) and with the cylinder (30) structured and arranged to be supported upon the head (40) of the screw (39); or (iii) additionally comprising a sleeve (41) provided with a flange (42) and structured and arranged to be fitted into a blind borehole (37) of a structure (35, 36) upon which the door (33) is movably or pivotally mounted, with the cylinder (30) structured and arranged to be fitted within the blind borehole (37).

10. A braking retardation apparatus in accordance with claim 9, wherein the fluid is oil.

11. A braking retardation apparatus for doors (3), and comprising a push rod which is structured and arranged to be pressed into a housing of a cylinder against a braking force, wherein the push rod is constituted by a piston or push rod of a piston structured and arranged to be movably guided in a cylinder (51), the cylinder (51) is structured and arranged to be filled with fluid and provided with a passage valve structured and arranged to counter extension of the piston with low resistance and retraction or insertion of the piston into the cylinder with high resistance, a compression spring structured and arranged to be clamped between the piston and a bottom of the cylinder (51), a head (56) fitted upon the piston or push rod, and comprising one of the following (i) and (ii):

(i) the cylinder (51) being structured and arranged to be mounted upon a front side of a frame of a top panel or side panel of a cupboard (51') facing a door or flap (52'), the fitted head (56) extending, in extended state of the piston or push rod, over or beyond the front side of the frame; and (ii) additionally said cylinder (51) being provided with a front flange (52) structured and arranged to contact an edge of a borehole in the frame of the top panel or side panel of the cupboard (51') facing the door or flap (52'), with the cylinder (51) being provided with a thread (53) upon which a nut (54) is structured and arranged to be threaded.

12. A braking retardation apparatus according to claim 11, wherein said frame is constituted by a rail (57) affixed to the cupboard.

13. A braking retardation apparatus according with claim 11, wherein said apparatus (50) is positioned onto a front side of the frame of the top or bottom panel of the cupboard facing the door or flap (52) at a distance (A) from a hinge edge (53) where the door or flap (52) is hinged to the cupboard approximately one-half of width of the door or flap (52) as measured from the hinge side (53).

* * * * *